US011302241B2

(12) United States Patent
Qu

(10) Patent No.: US 11,302,241 B2
(45) Date of Patent: Apr. 12, 2022

(54) PIXEL CIRCUIT FOR COMPENSATION FOR THRESHOLD VOLTAGE AND DRIVING METHOD THEREOF

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventor: Jiawei Qu, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 818 days.

(21) Appl. No.: 16/082,167

(22) PCT Filed: Jan. 12, 2018

(86) PCT No.: PCT/CN2018/072445
§ 371 (c)(1),
(2) Date: Sep. 4, 2018

(87) PCT Pub. No.: WO2018/227963
PCT Pub. Date: Dec. 20, 2018

(65) Prior Publication Data

US 2021/0272503 A1 Sep. 2, 2021

(30) Foreign Application Priority Data

Jun. 16, 2017 (CN) ..... 201710457169.3

(51) Int. Cl.
*G09G 3/30* (2006.01)
*G09G 3/20* (2006.01)
(Continued)

(52) U.S. Cl.
CPC ..... *G09G 3/2092* (2013.01); *G09G 3/3233* (2013.01); *G09G 3/3291* (2013.01);
(Continued)

(58) Field of Classification Search
CPC .. G09G 3/2092; G09G 3/3233; G09G 3/3291; G09G 2300/0426;
(Continued)

(56) References Cited

U.S. PATENT DOCUMENTS

2003/0062844 A1* 4/2003 Miyazawa ..... G09G 3/3241 315/169.3
2004/0026723 A1* 2/2004 Miyazawa ..... G09G 3/3233 257/277
(Continued)

FOREIGN PATENT DOCUMENTS

CN 1694135 A 11/2005
CN 102682705 A * 9/2012 ..... G09G 3/32
(Continued)

OTHER PUBLICATIONS

PCT International Search Report, Application No. PCT/CN2018/072445, dated Apr. 12, 2018, 8 pages: with English translation.
(Continued)

*Primary Examiner* — Adam J Snyder
(74) *Attorney, Agent, or Firm* — Armstrong Teasdale LLP

(57) ABSTRACT

Embodiments of the present disclosure provide a pixel circuit and a driving method thereof. The pixel circuit includes a data write circuit, which provides a data signal to a first node according to a control signal, a first control circuit, which provides a threshold compensation signal or an initialization signal to a second node according to the control signal, a capacitor, which stores a voltage difference between the first node and the second node, a second control circuit, which provides a first voltage signal to the driving
(Continued)

circuit according to the control signal, a compensation circuit, which provides the threshold compensation signal to the first control circuit, a driving circuit, which provides a driving current to the light emitting device according to the voltage of the first node and the first voltage signal, and a light emitting device, which emits light according to the driving current.

20 Claims, 6 Drawing Sheets

(51) Int. Cl.
*G09G 3/3233* (2016.01)
*G09G 3/3291* (2016.01)
*G09G 3/3208* (2016.01)

(52) U.S. Cl.
CPC ..... *G09G 3/3208* (2013.01); *G09G 2300/043* (2013.01); *G09G 2300/0426* (2013.01); *G09G 2300/0842* (2013.01); *G09G 2300/0861* (2013.01); *G09G 2310/061* (2013.01); *G09G 2310/08* (2013.01)

(58) Field of Classification Search
CPC ..... G09G 2300/043; G09G 2310/061; G09G 2300/0842; G09G 2300/0861; G09G 2310/08; G09G 3/3208
See application file for complete search history.

(56) References Cited

U.S. PATENT DOCUMENTS

2004/0090434 A1* 5/2004 Miyazawa ..... G09G 3/3241 345/204
2004/0095298 A1* 5/2004 Miyazawa ..... G09G 3/3233 345/76
2004/0201581 A1* 10/2004 Miyazawa ..... G09G 3/3233 345/204
2005/0052367 A1* 3/2005 Miyazawa ..... G09G 3/3241 345/76
2005/0243076 A1* 11/2005 Kim ..... G09G 3/3233 345/204
2005/0258867 A1* 11/2005 Miyazawa ..... G09G 3/3241 326/83
2006/0238135 A1* 10/2006 Kimura ..... G09G 3/20 315/169.3
2007/0040772 A1 2/2007 Kim
2007/0064469 A1* 3/2007 Umezaki ..... G09G 3/325 365/154
2014/0062843 A1* 3/2014 Yang ..... G09G 3/3233 345/76

FOREIGN PATENT DOCUMENTS

CN 102682705 A 9/2012
CN 102682706 A 9/2012
CN 104409047 A 3/2015
CN 105096831 A 11/2015
CN 105448243 A 3/2016
CN 105845081 A 8/2016
CN 106205495 A 12/2016
CN 107103880 A 8/2017

OTHER PUBLICATIONS

PCT Written Opinion, Application No. PCT/CN2018/072445, dated Apr. 12, 2018, 7 pages.: with English translation of relevant part.

* cited by examiner

PIXEL CIRCUIT FOR COMPENSATION FOR THRESHOLD VOLTAGE AND DRIVING METHOD THEREOF

CROSS REFERENCE TO RELATED APPLICATIONS

This patent application is a National Stage Entry of PCT/CN2018/072445 filed on Jan. 12, 2018, which claims the benefit and priority of Chinese Patent Application No. 201710457169.3 filed on Jun. 16, 2017, the disclosures of which are incorporated herein by reference in their entirety as part of the present application.

BACKGROUND

The present disclosure relates to the field of display technologies, and in particular, to a pixel circuit and a driving method thereof, an array substrate, and a display device.

With the advancement of display technology, compared with conventional liquid crystal display (LCD) devices, a new generation of organic light emitting diode (OLED) display devices has advantages of lower manufacturing cost, a faster response speed, higher contrast, a wider viewing angle, a greater operating temperature range, no need for a backlight unit, bright in color, and thin. Therefore, the OLED display technology has become the fastest growing display technology.

BRIEF DESCRIPTION

Embodiments of the present disclosure provide a pixel circuit and a driving method thereof, an array substrate, and a display device.

A first aspect of the present disclosure provides a pixel circuit. The pixel circuit includes a data write circuit, a first control circuit, a capacitor, a second control circuit, a compensation circuit, a driving circuit, and a light emitting device. The data write circuit is configured to provide a data signal from a data signal terminal to a first node according to a control signal from a control signal terminal. The first control circuit is configured to provide a threshold compensation signal from the compensation circuit or an initialization signal from an initialization signal terminal to a second node according to the control signal. The capacitor is configured to store a voltage difference between the first node and the second node. The second control circuit is configured to provide a first voltage signal of a first voltage signal terminal to the driving circuit according to the control signal. The compensation circuit is configured to provide the threshold compensation signal to the first control circuit according to the first voltage signal. The driving circuit is configured to provide a driving current to the light emitting device according to the voltage of the first node and the first voltage signal provided by the second control circuit. The light emitting device is configured to emit light according to the driving current.

In an embodiment of the present disclosure, the first control circuit may include a first transistor and a second transistor. A control electrode of the first transistor is coupled to the control signal terminal, a first electrode of the first transistor is coupled to the compensation circuit, and a second electrode of the first transistor is coupled to the second node. A control electrode of the second transistor is coupled to the control signal terminal, a first electrode of the second transistor is coupled to the initialization signal terminal, and a second electrode of the second transistor is coupled to the second node. The type of the first transistor is different from the type of the second transistor.

In an embodiment of the present disclosure, the driving circuit may include a third transistor. A control electrode of the third transistor is coupled to the first node, a first electrode of the third transistor is coupled to the second control circuit, and a second electrode of the third transistor is coupled to the light emitting device.

In an embodiment of the present disclosure, the compensation circuit may include a fourth transistor. A control electrode and a first electrode of the fourth transistor are coupled to the first control circuit, and a second electrode of the fourth transistor is coupled to the first voltage signal terminal.

In an embodiment of the present disclosure, the data write circuit may include a fifth transistor. A control electrode of the fifth transistor is coupled to the control signal terminal, a first electrode of the fifth transistor is coupled to the data signal terminal, and a second electrode of the fifth transistor is coupled to the first node.

In an embodiment of the present disclosure, the second control circuit may include a sixth transistor. A control electrode of the sixth transistor is coupled to the control signal terminal, a first electrode of the sixth transistor is coupled to the first voltage signal terminal, and a second electrode of the sixth transistor is coupled to the driving circuit.

In an embodiment of the present disclosure, the types of transistors in the driving circuit, the compensation circuit, and the second control circuit are different from the types of transistors in the data write circuit.

In an embodiment of the present disclosure, the pixel circuit may further include a reset circuit. The reset circuit is coupled in parallel with the light emitting device and coupled to the control signal terminal, and configured to reset the light emitting device according to the control signal.

In an embodiment of the present disclosure, the reset circuit may include a seventh transistor. A control electrode of the seventh transistor is coupled to the control signal terminal, and a first electrode and a second electrode of the seventh transistor are respectively coupled to both ends of the light emitting device.

In an embodiment of the present disclosure, the type of the seventh transistor is different from the type of the transistor in the driving circuit.

A second aspect of the present disclosure provides a pixel circuit including a first transistor, a second transistor, a third transistor, a fourth transistor, a fifth transistor, a sixth transistor, a capacitor, and a light emitting device. A control electrode of the first transistor is coupled to a control signal terminal, a first electrode of the first transistor is coupled to a control electrode of the fourth transistor, and a second electrode of the first transistor is coupled to a second node. A control electrode of the second transistor is coupled to the control signal terminal, a first electrode of the second transistor is coupled to an initialization signal terminal, and a second electrode of the second transistor is coupled to the second node. The capacitor is coupled between the first node and the second node. A control electrode of the third transistor is coupled to the first node, a first electrode of the third transistor is coupled to a second electrode of the sixth transistor, and a second electrode of the third transistor is coupled to a first end of the light emitting device. A control electrode and a first electrode of the fourth transistor are coupled to the first electrode of the first transistor, and a second electrode of the fourth transistor is coupled to a first voltage signal terminal. A control electrode of the fifth transistor is coupled to the control signal terminal, a first electrode of the fifth transistor is coupled to a data signal terminal, and a second electrode of the fifth transistor is coupled to the first node. A control electrode of the sixth transistor is coupled to the control signal terminal, a first electrode of the sixth transistor is coupled to the first voltage signal terminal, and a second electrode of the sixth transistor is coupled to the first electrode of the third transistor. The first end of the light emitting device is coupled to the second electrode of the third transistor, and a second end of the light emitting device is coupled to a second voltage signal terminal. The type of the first transistor is different from the type of the second transistor.

In an embodiment of the present disclosure, the types of the third transistor, the fourth transistor, and the sixth transistor are different from the type of the fifth transistor.

In an embodiment of the present disclosure, the pixel circuit further includes a seventh transistor. A control electrode of the seventh transistor is coupled to the control signal terminal, a first electrode of the seventh transistor is coupled to the first end of the light emitting device, and a second electrode of the seventh transistor is coupled to the second voltage signal terminal.

In an embodiment of the present disclosure, the type of the seventh transistor is different from the type of the third transistor.

A third aspect of the present disclosure provides a method for driving the above pixel circuit. In this method, in a first time period, under the control of a control signal, providing a data signal to a first node and providing an initialization signal to a second node to charge a capacitor, in a second time period, under the control of the control signal, providing a threshold compensation signal to the second node, maintaining a voltage difference between the first node and the second node through the capacitor to control the voltage of the first node, and causing a light emitting device to emit light according to the voltage of the first node and a first voltage signal of a first voltage signal terminal.

In an embodiment of the present disclosure, the light emitting device is reset under the control of the control signal in the first time period.

A fourth aspect of the present disclosure provides an array substrate including the pixel circuit as above.

A fifth aspect of the present disclosure provides a display device including the array substrate as above.

BRIEF DESCRIPTION OF THE DRAWINGS

In order to illustrate the technical solutions of the present disclosure more clearly, the drawings of the embodiments will be briefly described below. It should be appreciated that the drawings described below relate to only some of the embodiments of the present disclosure, rather than limiting the present disclosure, in which.

DETAILED DESCRIPTION

In order to make the technical solutions and advantages of the embodiments of the present disclosure clearer, the technical solutions of the embodiments of the present disclosure will be clearly and completely described below in conjunction with the accompanying drawings. Obviously, the described embodiments are merely part of the embodiments of the present disclosure, rather than all of the embodiments. Based on the described embodiments, all the other embodiments obtained by those of ordinary skill in the art without creative labor also fall within the scope of protection of the present disclosure.

In the following text, the expression "the element A is coupled to the element B" means that the element A is "directly" connected to the element B or "indirectly" connected to the element B through one or more other elements, unless otherwise stated.

At present, usually by changing a gate voltage of a driving transistor which directly drives an OLED to emit light, the magnitude of current between a source and a drain of the driving transistor can be controlled, such that it can realize a change in the luminance of emitted light. However, in the process of manufacturing driving transistors, the threshold voltage of driving transistors at different positions may be different due to process variations. In addition, accompanied by long operating time and usage environment changes, the threshold voltage of driving transistors may drift. On the other hand, in a display device, different positions of pixels may also result in different voltage drops (I-R Drops) for the power source, thereby affecting the current that drives the OLED.

Figure 1:
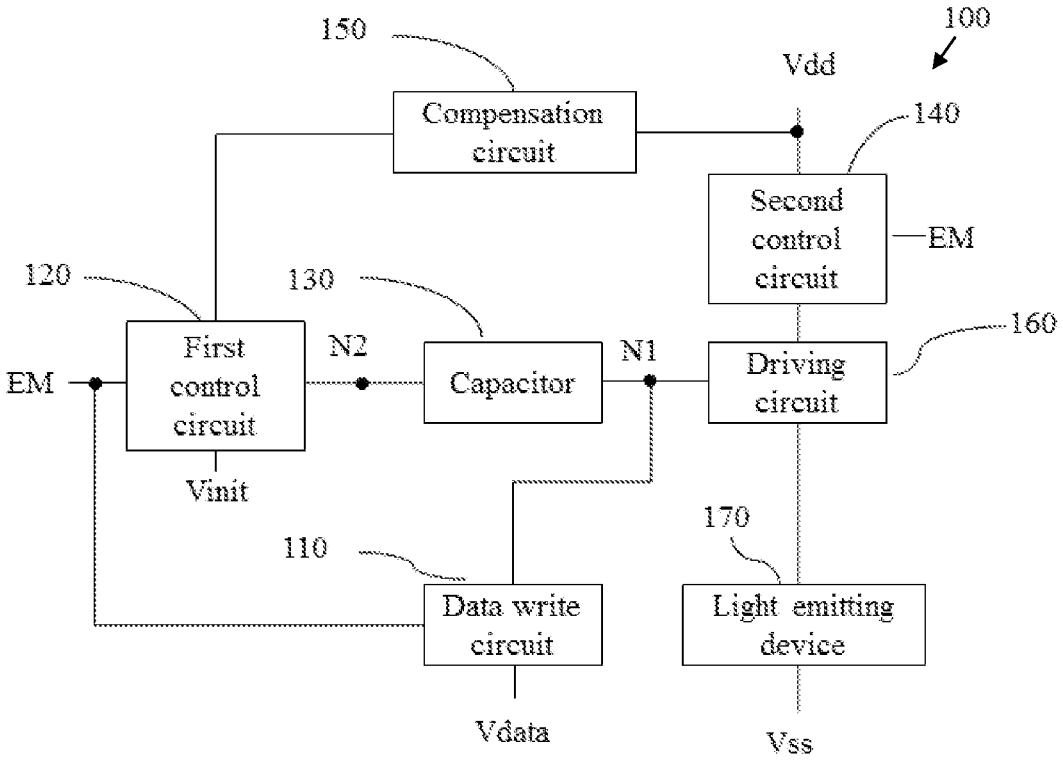
FIG. 1 is a schematic block diagram of a pixel circuit according to a first embodiment of the present disclosure.

FIG. 1 shows a schematic block diagram of a pixel circuit 100 according to a first embodiment of the present disclosure. As shown in FIG. 1, the pixel circuit 100 may include a data write circuit 110, a first control circuit 120, a capacitor 130, a second control circuit 140, a compensation circuit 150, a driving circuit 160, and a light emitting device 170. In an embodiment of the present disclosure, each of the capacitor 130, the compensation circuit 150, and the light emitting device 170 has a first end and a second end. Each of the data write circuit 110 and the second control circuit 140 has a control end, a first end, and a second end. The first control circuit 120 has a third end in addition to a control end, a first end, and a second end. The driving circuit 160 has a first end, a second end, and a third end.

The control end of the data write circuit 110 is coupled to a control signal terminal EM, the first end of the data write circuit 110 is coupled to a data signal terminal Vdata, and the second end of the data write circuit 110 is coupled to a first node N1 (i.e., coupled to the second end of the capacitor 130 and the second end of the driving circuit 160). The data write circuit 110 can provide a data signal from the data signal terminal Vdata to the first node N1 under the control of a control signal from the control signal terminal EM, and then provide it to the capacitor 130 and the driving circuit 160.

The control end of the first control circuit 120 is coupled to the control signal terminal EM, the first end of the first control circuit 120 is coupled to the second end of the compensation circuit 150, the second end of the first control circuit 120 is coupled to an initialization signal terminal Vinit, and the third end of the first control circuit 120 is coupled to a second node N2 (i.e., coupled to the first end of the capacitor 130). The first control circuit 120 may provide a threshold compensation signal from the compensation circuit 150 or an initialization signal from the initialization signal terminal Vinit to the second node N2 under the control of a control signal, and then provide to the capacitor 130.

The first end of the capacitor 130 is coupled to the second node N2, and the second end of the capacitor 130 is coupled to the first node N1. The capacitor 130 can store a voltage difference between the first node N1 and the second node N2.

The control end of the second control circuit 140 is coupled to the control signal terminal EM, the first end of the second control circuit 140 is coupled to a first voltage signal terminal Vdd, and the second end of the second control circuit 140 is coupled to the first end of the driving circuit 160. The second control circuit 140 can provide a first voltage signal from the first voltage signal terminal Vdd to the driving circuit 160 under the control of the control signal.

The first end of the compensation circuit 150 is coupled to the first voltage signal terminal Vdd, and the second end of the compensation circuit 150 is coupled to the first end of the first control circuit 120. The compensation circuit 150 can provide a threshold compensation signal to the first control circuit.

The first end of the driving circuit 160 is coupled to the second end of the second control circuit 140, and the second end of the driving circuit 160 is coupled to the first node N1 (i.e., coupled to the second end of the capacitor 130 and the second end of the data write circuit 110), and the third end of the driving circuit 160 is coupled to the first end of the light emitting device 170. The driving circuit 160 can provide a driving current to the light emitting device 170 according to the voltage of the first node N1 and the first voltage signal.

The first end of the light emitting device 170 is coupled to the third end of the driving circuit 160, and the second end of the light emitting device 170 is coupled to a second voltage signal terminal Vss. The light emitting device 170 can emit light according to the driving current provided from the driving circuit 160.

In an embodiment of the present disclosure, the first voltage signal from the first voltage signal terminal Vdd is a high level signal, and the second voltage signal from the second voltage signal terminal Vss is a low level signal.

In an embodiment of the present disclosure, the pixel circuit 100 may be implemented using transistors, wherein the transistors may be N-type transistors or P-type transistors. Specifically, the transistors may be N-type or P-type field effect transistors (MOSFETs), or N-type or P-type bipolar transistors (BJTs). In an embodiment of the present disclosure, a gate of a transistor is referred to as a control electrode. Since a source and a drain of the transistor are symmetrical, the source and the drain are not distinguished, that is, the source of the transistor can be the first electrode (or the second electrode), and the drain can be the second electrode (or the first electrode). Further, any controlled switch device having a gating signal input can be used to implement the function of a transistor, and a controlled end of the switch device for receiving a control signal (e.g., for turning on and off the controlled switch device) is referred to as the control electrode, the other two ends as the first electrode and the second electrode, respectively. Hereinafter, detailed descriptions will be given by taking example of P-type field effect transistors (NMOS) and N-type field effect transistors (NMOS).

Figure 2:
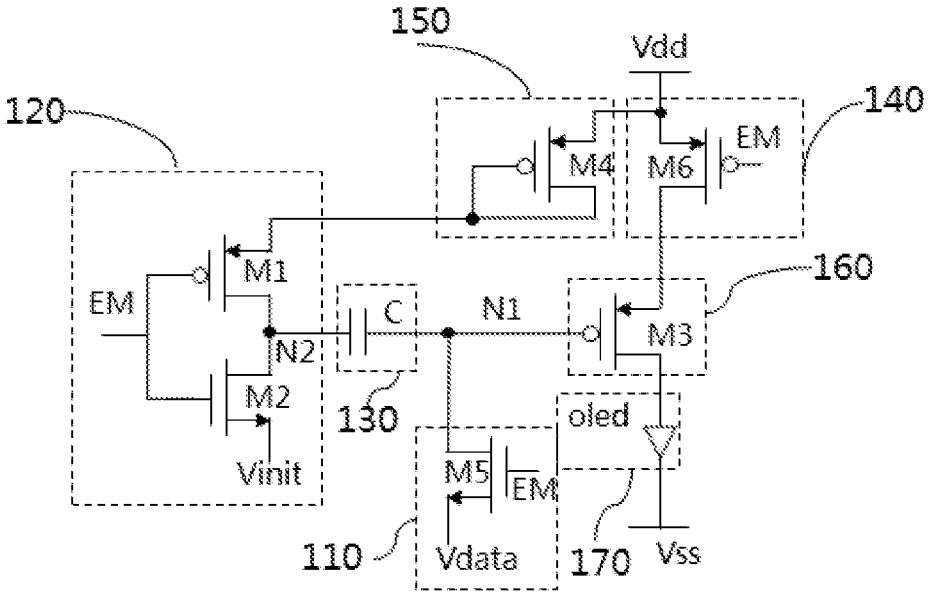
FIG. 2 is an exemplary circuit diagram of the pixel circuit shown in FIG. 1.

FIG. 2 shows an exemplary circuit diagram of the pixel circuit 100 shown in FIG. 1.

As shown in FIG. 2, the data write circuit 110 may include a fifth transistor M5. A control electrode of the fifth transistor M5 is coupled to the control signal terminal EM, a first electrode of the fifth transistor M5 is coupled to the data signal terminal Vdata, and a second electrode of the fifth transistor M5 is coupled to the first node N1.

The first control circuit 120 may include a first transistor M1 and a second transistor M2. A control electrode of the first transistor M1 is coupled to the control signal terminal EM, a first electrode of the first transistor M1 is coupled to the compensation circuit 150, and a second electrode of the first transistor M1 is coupled to the second node N2. A control electrode of the second transistor M2 is coupled to the control signal terminal EM, a first electrode of the second transistor M2 is coupled to the initialization signal terminal Vinit, and a second electrode of the second transistor M2 is coupled to the second node N2.

The capacitor 130 may include a capacitor C. A first end of the capacitor C is coupled to the second node N2, and a second end of the capacitor C is coupled to the first node N1.

The second control circuit 140 may include a sixth transistor M6. A control electrode of the sixth transistor M6 is coupled to the control signal terminal EM, a first electrode of the sixth transistor M6 is coupled to the first voltage signal terminal Vdd, and a second electrode of the sixth transistor M6 is coupled to the driving circuit 160.

The compensation circuit 150 may include a fourth transistor M4. A control electrode and a first electrode of the fourth transistor M4 are coupled to the first control circuit 120, and a second electrode of the fourth transistor M4 is coupled to the first voltage signal terminal Vdd.

The driving circuit 160 may include a third transistor M3. A control electrode of the third transistor M3 is coupled to the first node N1, a first electrode of the third transistor M3 is coupled to the second control circuit 140, and a second electrode of the third transistor M3 is coupled to the light emitting device 170.

The light emitting device 170 mays include an OLED device. A first end of the OLED device is coupled to the driving circuit 160, and a second end of the OLED device is coupled to the second voltage signal terminal Vss. Further, the first end of the OLED device is an anode and the second end of the OLED device is a cathode.

Figure 3:
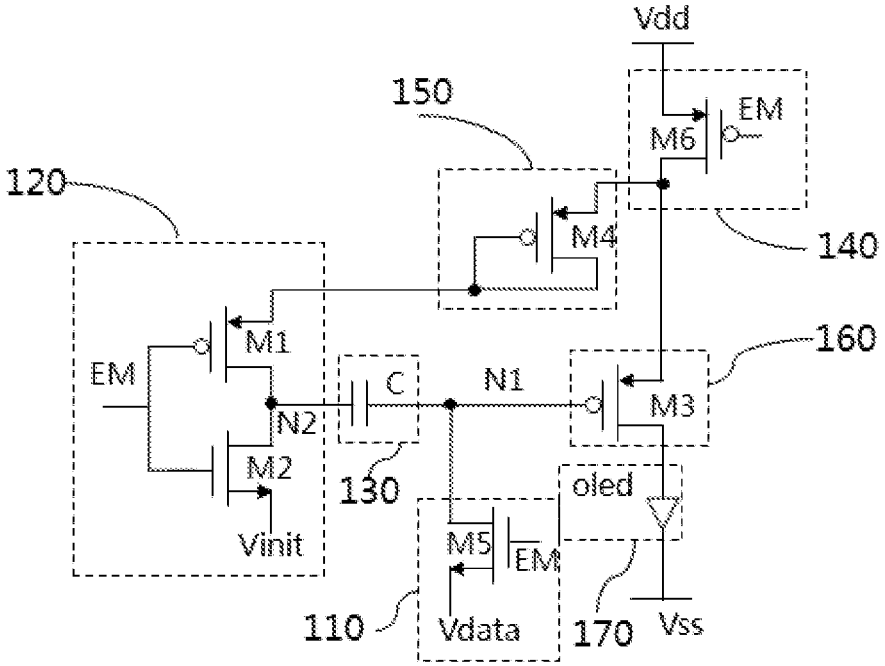
FIG. 3 is another exemplary circuit diagram of the pixel circuit shown in FIG. 1.

FIG. 3 shows another exemplary circuit diagram of the pixel circuit 100 shown in FIG. 1. As shown in FIG. 3, the second electrode of the fourth transistor M4 in the compensation circuit 150 is coupled to the second electrode of the sixth transistor M6, that is, the second electrode of the fourth transistor M4 is coupled to the first voltage signal terminal Vdd through the second control circuit 140. Except for this, the pixel circuit shown in FIG. 3 has the same structure as the pixel circuit shown in FIG. 2 and will not be described again.

As shown in FIGS. 2 and 3, the first transistor M1, the third transistor M3, the fourth transistor M4, and the sixth transistor M6 are P-type transistors, and the second transistor M2, the fifth transistor M5, and the seventh transistor M7 are N-type transistors. In addition, in the manufacturing process, as the third transistor M3 is close to the fourth transistor M4 and the manufacturing effect is relatively small, it can be considered that threshold voltages of the two transistors are approximately equal, which can be collectively referred to as a threshold voltage Vth (which represents a threshold voltage of a transistor, wherein a threshold voltage of a PMOS is a negative value, and a threshold voltage of an NMOS is a positive value).

In an embodiment of the present disclosure, the first voltage signal provided by the first voltage signal terminal Vdd, the second voltage signal provided by the second voltage signal terminal Vss, and the data signal provided by the data signal terminal Vdata are direct current (DC) signals.

In an embodiment of the present disclosure, the threshold compensation signal provided by the compensation circuit 150 is the sum of the voltage of the first voltage signal Vdd and the threshold voltage Vth of the fourth transistor M4, that is, Vdd+Vth. The voltage of the initialization signal provided by the initialization signal terminal Vinit is less than the voltage of the threshold compensation signal. In addition, the voltage of the initialization signal Vinit is also greater than the voltage of the data signal Vdata. Therefore, the voltage of the first voltage signal Vdd is greater than the difference between the voltage of the data signal Vdata and the threshold voltage Vth of the third transistor, that is, Vdata-Vth.

Figure 4:
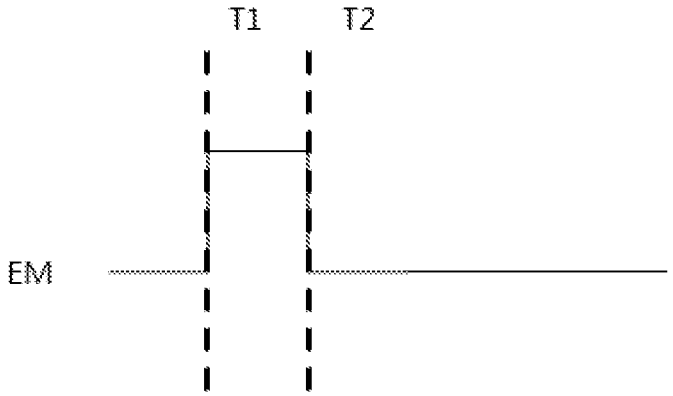
FIG. 4 shows a timing diagram of control signals for a pixel circuit.

FIG. 4 shows a timing chart of control signals provided from the control signal terminal EM of the pixel circuit. The operation process of the pixel circuit shown in FIGS. 2 and 3 will be described in detail below in conjunction with FIG. 4. Specifically, the first voltage signal terminal Vdd provides a first voltage signal which is at a high level, and the second voltage signal terminal Vss provides a second voltage signal which is at a low level.

In a first time period (T1), the control signal EM is a high level signal, the second transistor M2, the fifth transistor M5, and the seventh transistor M7 are turned on, and the first transistor M1, the third transistor M3, the fourth transistor M4, and the sixth transistor M6 are turned off. The data signal Vdata is provided to the first node N1 through the fifth transistor M5, so that the voltage of the first plate (i.e., the first node N1) of the capacitor C becomes Vdata. The (Clean) Specification initialization signal Vinit is provided to the second node N2 through the second transistor M2, so that the voltage of the second plate (i.e., the second node N2) of the capacitor C becomes Vinit. Thus, the capacitor C stores charge and the voltage difference across the capacitor C is Vdata-Vinit.

In a second time period (T2), the control signal EM is a low level signal, the first transistor M1, the third transistor M3, the fourth transistor M4 and the sixth transistor M6 are turned on, the second transistor M2, the fifth transistor M5 and the seventh transistor M7 are turned off. The first voltage signal is provided to the second plate of the capacitor through the diode-connected fourth transistor M4 and the first transistor M1, that is, the threshold compensation signal (i.e., Vdd+Vth) is provided to the second plate of the capacitor, so that the voltage of the second node N2 becomes Vdd+Vth. Since the amount of charge of the capacitor C does not change, the voltage difference across the capacitor C does not change. Therefore, the voltage of the first node N1 becomes Vdd+Vth+Vdata-Vinit, and drives the third transistor M3 to generate a driving current I for causing the OLED device to emit light.

The driving current I can be expressed as:

$$I = \frac{W}{2L}\mu C_{OX}(V_{GS} - V_{TH})^2$$

Where W/L is the width to length ratio of the third transistor M3, μ, is hole mobility, Cox is gate capacitance, VGS is the gate-source voltage of the third transistor M3, and Vth is the threshold voltage of the third transistor M3.

As the gate voltage of the third transistor M3 is Vdd+Vth+Vdata−Vinit and the source voltage is Vdd, the driving current I can be expressed as:

$$\begin{aligned} I &= \frac{W}{2L}\mu C_{OX}(V_{dd} + V_{th} + V_{data} - V_{init} - V_{dd} - V_{th})^2 \\ &= \frac{W}{2L}\mu C_{OX}(V_{data} - V_{init})^2 \end{aligned}$$

From above, the driving current I is only in relation to the data signal Vdata and the initial signal Vinit, and is irrelevant with the threshold voltage Vth of the third transistor M3 and the voltage of the first voltage signal Vdd. Therefore, the driving current of the OLED device is not affected by the threshold voltage Vth and the power source I-R Drop of the first voltage signal Vdd at different pixel positions.

Figure 5:
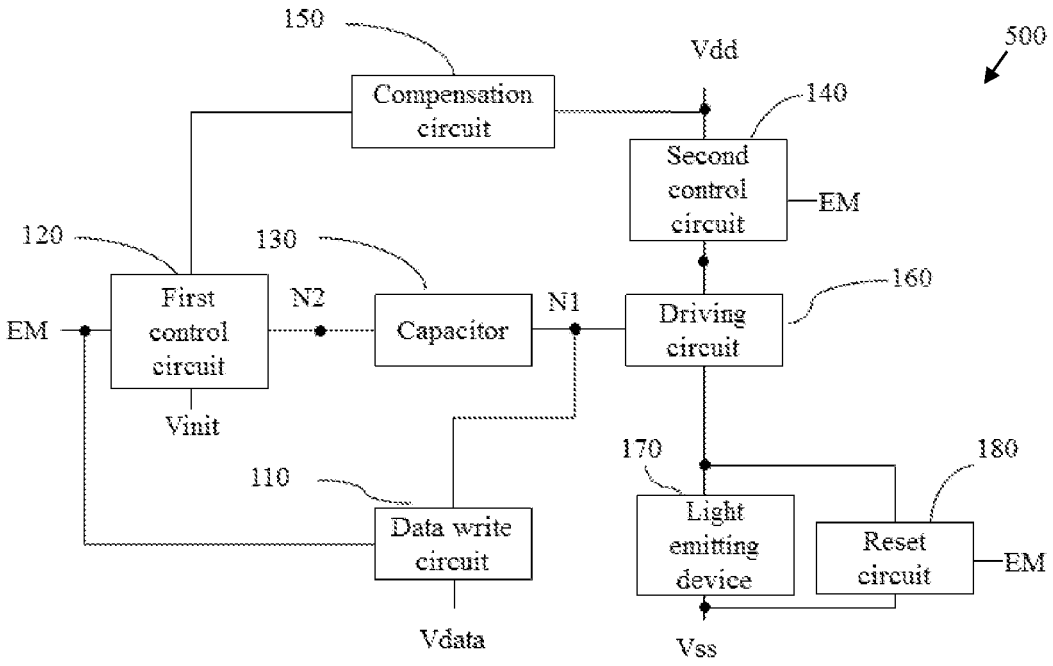
FIG. 5 is a schematic block diagram of a pixel circuit according to a second embodiment of the present disclosure.

FIG. 5 shows a schematic block diagram of a pixel circuit 500 according to a second embodiment of the present disclosure. As shown in FIG. 5, in addition to the data write circuit 110, the first control circuit 120, the capacitor 130, the second control circuit 140, the compensation circuit 150, the driving circuit 160, and the light emitting device 170, the pixel circuit 500 further includes a reset circuit 180. The reset circuit 180 is coupled in parallel with the light emitting device 170 and coupled to the control signal terminal EM. The reset circuit 180 can reset the light emitting device 170 under the control of a control signal.

Figure 6:
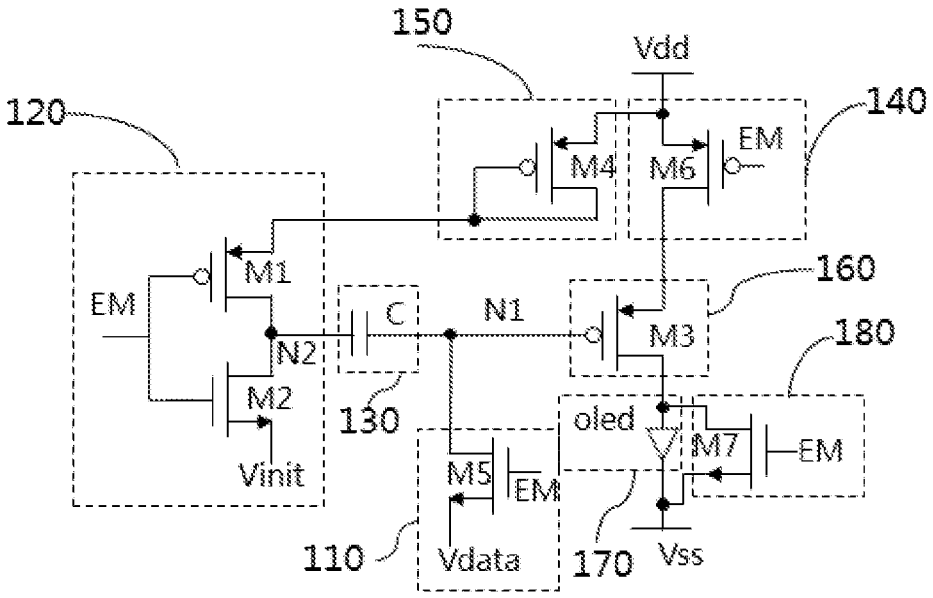
FIG. 6 is an exemplary circuit diagram of the pixel circuit shown in FIG. 5, wherein the driving circuit uses a P-type transistor.

FIG. 6 shows an exemplary circuit diagram of the pixel circuit 500 shown in FIG. 5, wherein the third transistor M3 in the driving circuit 160 employs a P-type transistor. As shown in FIG. 6, the reset circuit 180 may include a seventh transistor M7, and the seventh transistor M7 is an N-type transistor. A control electrode of the seventh transistor M7 is coupled to the control signal terminal EM, a first electrode of the seventh transistor M7 is coupled to the first end of the light emitting device 170, and a second electrode of the seventh transistor M7 is coupled to the second voltage signal terminal. In addition, the pixel circuit shown in FIG. 6 has the same structure as the pixel circuit shown in FIG. 2 and will not be described again.

Figure 7:
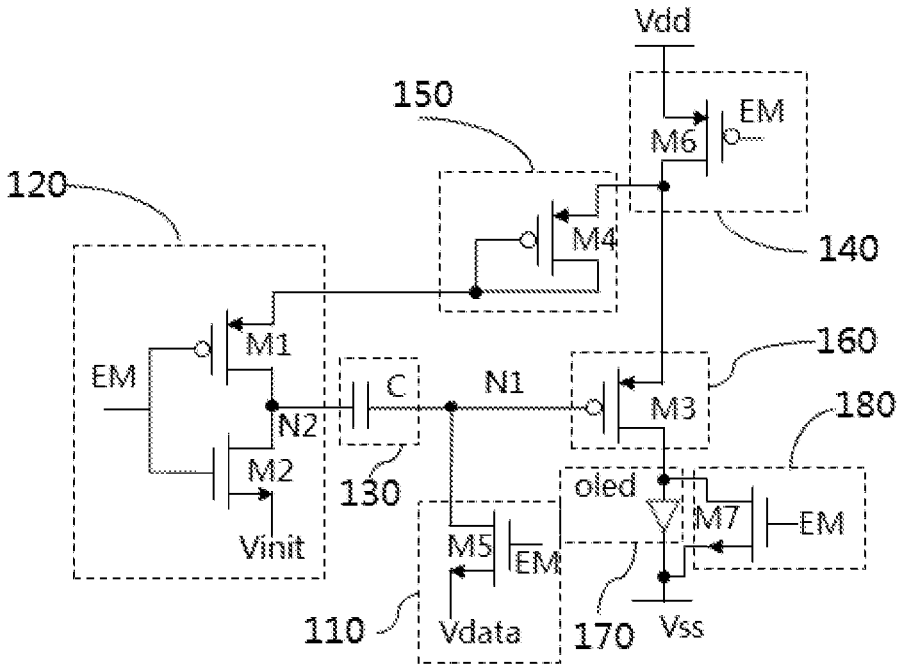
FIG. 7 is another exemplary circuit diagram of the pixel circuit shown in FIG. 5, wherein the driving circuit uses a P-type transistor.

FIG. 7 shows another exemplary circuit diagram of the pixel circuit 500 shown in FIG. 5, wherein the third transistor M3 in the driving circuit 160 employs a P-type transistor. As shown in FIG. 7, the second electrode of the fourth transistor M4 in the compensation circuit 150 can be coupled to the second electrode of the sixth transistor M6. In addition, the pixel circuit shown in FIG. 7 has the same structure as the pixel circuit shown in FIG. 6, and will not be described again.

In the operation process of the pixel circuit shown in FIGS. 6 and 7, in addition to the above-described data writing, compensation of threshold voltage, and power source I-R Drop and light emission, the light emitting device can be reset. Specifically, in the first time period (T1), the second voltage signal Vss is also provided to the anode of the OLED device through the seventh transistor M7, thereby resetting the OLED device to ensure the stability of the current for driving the OLED device, and preventing the OLED device from abnormally emitting light.

Figure 8:
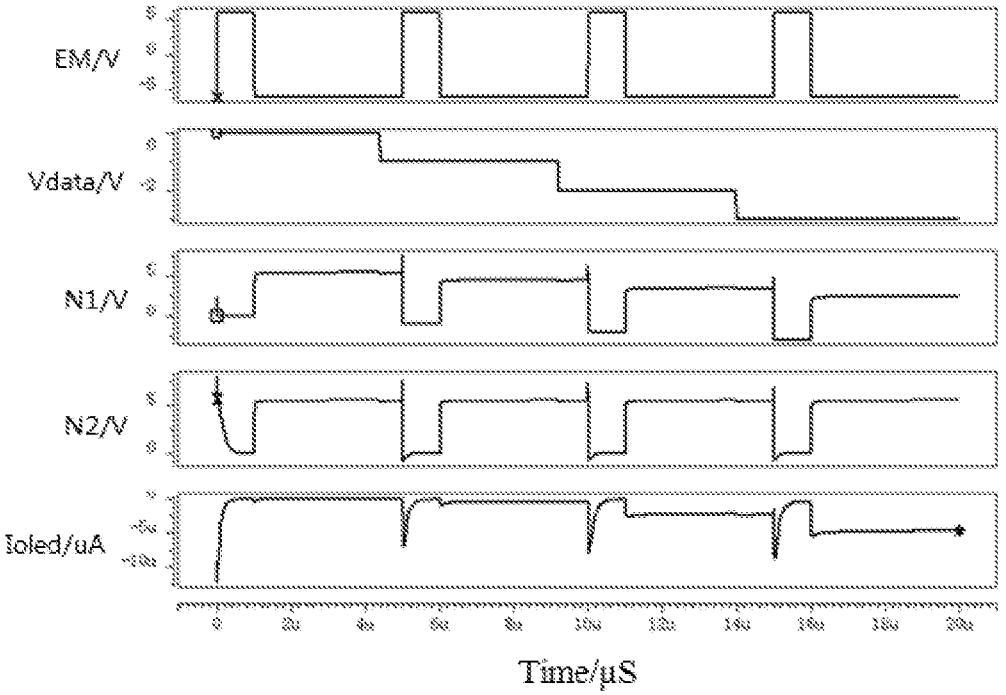
FIG. 8 is a simulation diagram of signals in the pixel circuit shown in FIG. 2.
Figure 9:
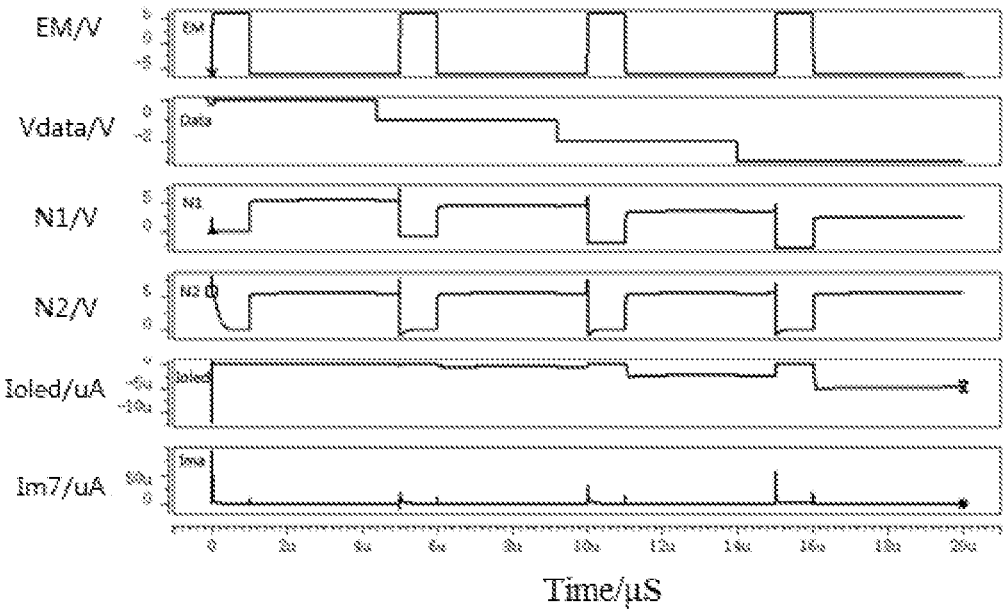
FIG. 9 is a simulation diagram of signals in the pixel circuit shown in FIG. 6.

The operational effects of the two embodiments of the present disclosure will be described below with reference to FIGS. 8 and 9. FIG. 8 is a simulation diagram of signals in the pixel circuit shown in FIG. 2. These signals are the control signal EM, the data signal Vdata, the voltage signal of the first node N1, the voltage signal of the second node N2, and the driving current signal bled. FIG. 9 is a simulation diagram of signals in the pixel circuit shown in FIG. 6. In addition to the above signals, a current signal Im7 flowing through the seventh transistor M7 is also included.

As there are parasitic capacitances Cgd1 and Cgd2 at the gate and drain of the first transistor M1 and the second transistor M2 in the first control circuit 120, it is equivalent to the second node N2 being alternating current grounded, and thus the gate-drain parasitic capacitance of the first transistor M1 and the second transistor M2 is the parallel value of Cgd1 and Cgd2, which is Cgd1+Cgd2. At a moment when the control signal EM changes from a low level to a high level, a part of the control signal EM is coupled to the second plate (that is, the second node N2) of the capacitor C through the gate-drain parasitic capacitance Cgd1+Cgd2 of the first transistor M1 and the second transistor M2. Thus, the first transistor M1 is not completely switched to a turned-off state and the second transistor M2 is not completely switched to a turned-on state. Therefore, incomplete writing of the initialization signal Vinit can also cause the diode-connected transistor M4 to be turned on, thereby partially writing the first voltage signal Vdd to the second node N2. A part of the control signal EM and the signal written by the first voltage signal terminal Vdd are then capacitive coupled to the first plate (i.e., the first node N1) of the capacitor C. Thereafter, the gate-drain capacitance Cgd of the third transistor M3 is coupled to the anode of the OLED, thereby generating a pulse current to the OLED, and causing the OLED to emit light. However, controlling the seventh transistor M7 through the control signal EM may filter the pulse current so that the pulse current does not pass through the OLED, and the OLED is prevented from abnormally emitting light. After the EM becomes a high level, after the second node N2, and the first node N1 reach a stable state, the voltages of the second node N2 and the first node N1 become Vinit and Vdata, reaching a stable state.

As shown in FIG. 8, when the control signal EM changes from a low level to a high level, the voltage of the second node N2 and the voltage of the first node N1 have a spike which causes the OLED to have a large pulse current. As shown in FIG. 9, in the process of using the transistor M7, the second node N2, and the first node N1 also have a spike voltage, and the spike current is directed through the seventh transistor M7 to the second voltage signal terminal Vss, without passing through the OLED. Therefore, there is no pulse current in the OLED current, and the OLED does not emit light in the switching state. In this way, even under the control of a single control signal, the output current of the OLED pixel circuit can also be controlled to be stabilized, thereby driving the OLED to emit light.

Figure 10:
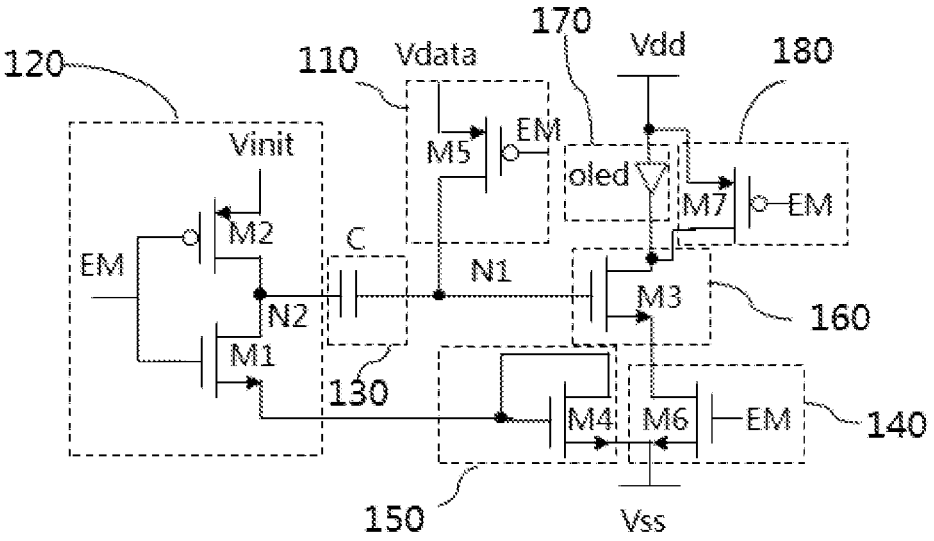
FIG. 10 is another exemplary circuit diagram of the pixel circuit shown in FIG. 5, wherein the driving circuit uses an N-type transistor.

FIG. 10 shows still another exemplary circuit diagram of the pixel circuit shown in FIG. 5, wherein the third transistor M3 in the driving circuit 160 uses an N-type transistor. As shown in FIG. 10, the first transistor M1, the third transistor M3, and the sixth transistor M6 are N-type transistors, and the second transistor M2, the fifth transistor M5, and the seventh transistor M7 are P-type transistors. Correspondingly, the coupling relationship between the transistors and the first and second voltage signal terminals also changes. Specifically, for the second control circuit 140, the first electrode of the sixth transistor M6 is coupled to the second voltage signal terminal Vss. For the compensation circuit 150, the second electrode of the fourth transistor M4 is coupled to the second voltage signal terminal Vss. For the light emitting device 170, the first end of the OLED device is coupled to the driving circuit 160, the second end of the OLED device is coupled to the first voltage signal terminal Vdd, and the first end of the OLED device is a cathode and the second end of the OLED device is an anode. In addition, the structure of the pixel circuit shown in FIG. 10 is similar to the structure of the pixel circuit shown in FIG. 2, the operation timing is also similar, and they will not be described in detail herein again.

Figure 11:
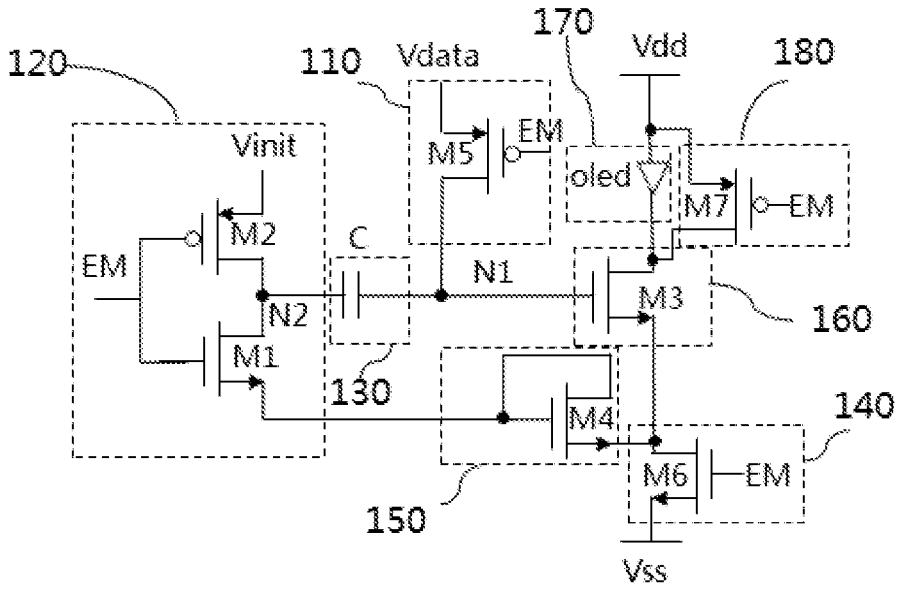
FIG. 11 is another exemplary circuit diagram of the pixel circuit shown in FIG. 5, wherein the driving circuit uses an N-type transistor.

FIG. 11 shows yet another exemplary circuit diagram of the pixel circuit shown in FIG. 5, wherein the third transistor M3 in the driving circuit 160 uses an N-type transistor. Different from FIG. 10, in the pixel circuit shown in FIG. 11, the second electrode of the fourth transistor M4 in the compensation circuit 150 is coupled to the second electrode of the sixth transistor M6 in the second control circuit.

Figure 12:
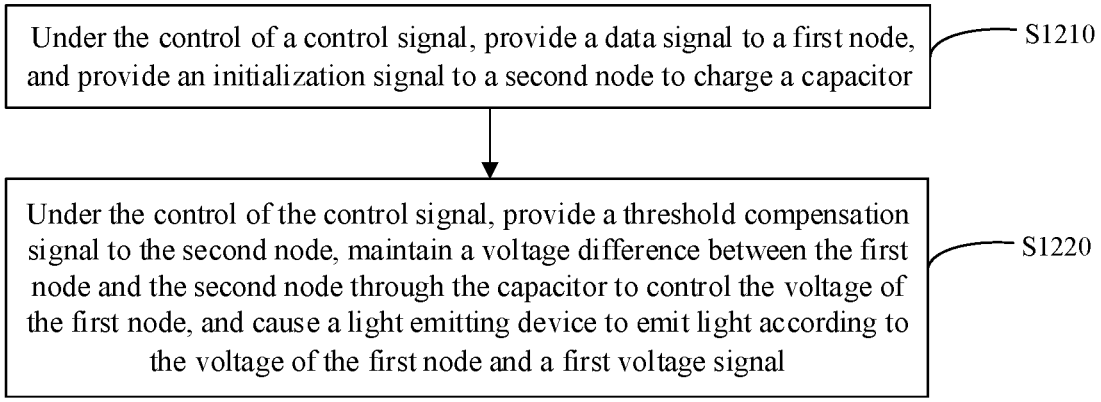
FIG. 12 is a schematic flowchart of a method for driving the pixel circuit as shown in FIG. 1 according to an embodiment of the present disclosure.

FIG. 12 is a schematic flowchart of a method for driving the pixel circuit as above according to an embodiment of the present disclosure. In an embodiment of the present disclosure, the first voltage signal terminal provides a first voltage signal of a high level, and the second voltage signal terminal provides a second voltage signal of a low level.

In step S1210, under the control of the control signal EM, the data write circuit 110 or the fifth transistor M5 is turned on to provide the data signal Vdata to the first node N1 through the data write circuit 110 or the fifth transistor M5, and provide the initialization signal Vinit to the second node N2 through the first control circuit 120 or the second transistor M2. The capacitor 130 or the capacitor C stores the voltage difference between the first node N1 and the second node N2, that is, Vdata-Vinit.

In step S1220, under the control of the control signal EM, the second control circuit 140 or the sixth transistor M6 and the driving circuit 160 or the third transistor M3 are turned on, to provide a threshold compensation signal (i.e., Vdd+Vth) to the second node N2 through the compensation circuit 150 or the fourth transistor M4 and the first control circuit 120 or the first transistor M1. The voltage difference between the first node N1 and the second node N2 is maintained through the capacitor 130 or the capacitor C as Vdata-Vinit, to control the voltage of the first node N1 to become Vdd+Vth+Vdata-Vinit. The light emitting device 170 or the OLED device is caused to emit light according to the voltage of the first node N1 and the first voltage signal.

In addition, for the pixel circuit 500 shown in FIG. 5, in step S1210, the light emitting device 170 can also be reset through the reset circuit 180 or the seventh transistor M7 under the control of the control signal EM, to ensure the stability of the driving current for driving the light emitting device 170 or the OLED device, preventing the light emitting device 170 or the OLED device from abnormally emitting light.

The pixel circuit according to an embodiment of the present disclosure can use a single control signal to realize data writing, resetting, compensation of threshold voltage and power source I-R Drop and light emission for the pixel circuit in two stages, thereby improving the processing speed and stability of the circuit. With the pixel circuit according to the embodiments of the present disclosure, it is possible to reduce the number of control signals, increase the wiring margin of internal signals, simplify the design of the peripheral signal driving circuit, and reduce crosstalk between signals.

Several embodiments of the present disclosure have been described in detail above, but the scope of protection of the present disclosure is not limited thereto. Apparently, those of ordinary skill in the art may make various modifications, substitutions or variants to the embodiments of the present disclosure without departing from the spirit and scope of the present disclosure. The scope of protection of the present disclosure is defined by the appended claims.

What is claimed is:

1. A pixel circuit comprising a data write circuit, a first control circuit, a capacitor, a second control circuit, a compensation circuit, a driving circuit, and a light emitting device;

wherein the data write circuit is configured to provide a data signal from a data signal terminal to a first node according to a control signal from a control signal terminal;

wherein the first control circuit is configured to provide a threshold compensation signal from the compensation circuit or an initialization signal from an initialization signal terminal to a second node according to the control signal;

wherein the capacitor is configured to store a voltage difference between the first node and the second node;

wherein the second control circuit is configured to provide a first voltage signal of a first voltage signal terminal to the driving circuit according to the control signal;

wherein the compensation circuit is configured to provide the threshold compensation signal to the first control circuit according to the first voltage signal;

wherein the driving circuit is configured to provide a driving current to the light emitting device according to the voltage of the first node and the first voltage signal provided by the second control circuit; and wherein the light emitting device is configured to emit light according to the driving current.

2. The pixel circuit according to claim 1, wherein the first control circuit comprises:

a first transistor comprising a control electrode coupled to the control signal terminal, a first electrode coupled to the compensation circuit, and a second electrode coupled to the second node; and a second transistor comprising a control electrode coupled to the control signal terminal, a first electrode coupled to the initialization signal terminal, and a second electrode coupled to the second node, wherein the type of the first transistor is different from the type of the second transistor.

3. The pixel circuit according to claim 2, further comprising a reset circuit, wherein the reset circuit is coupled in parallel with the light emitting device and coupled to the control signal terminal, and configured to reset the light emitting device according to the control signal.

4. The pixel circuit according to claim 1, wherein the driving circuit comprises:

a third transistor comprising a control electrode coupled to the first node, a first electrode coupled to the second control circuit, and a second electrode coupled to the light emitting device.

5. The pixel circuit according to claim 4, further comprising a reset circuit, wherein the reset circuit is coupled in parallel with the light emitting device and coupled to the control signal terminal, and configured to reset the light emitting device according to the control signal.

6. The pixel circuit according to claim 1, wherein the compensation circuit comprises:

a fourth transistor comprising a control electrode and a first electrode coupled to the first control circuit, and a second electrode coupled to the first voltage signal terminal.

7. The pixel circuit according to claim 1, wherein the data write circuit comprises:

a fifth transistor comprising a control electrode coupled to the control signal terminal, a first electrode coupled to the data signal terminal, and a second electrode coupled to the first node.

8. The pixel circuit according to claim 1, wherein the second control circuit comprises:

a sixth transistor comprising a control electrode coupled to the control signal terminal, a first electrode coupled to the first voltage signal terminal, and a second electrode coupled to the driving circuit.

9. The pixel circuit according to claim 1, wherein the types of transistors in the driving circuit, the compensation circuit, and the second control circuit are different from the types of transistors in the data write circuit.

10. The pixel circuit according to claim 1, further comprising a reset circuit, the reset circuit is coupled in parallel with the light emitting device and coupled to the control signal terminal, and configured to reset the light emitting device according to the control signal.

11. The pixel circuit according to claim 10, wherein the reset circuit comprises:

a seventh transistor comprising a control electrode coupled to the control signal terminal, and a first electrode and a second electrode coupled to both ends of the light emitting device respectively.

12. The pixel circuit according to claim 11, wherein the type of the seventh transistor is different from the type of the transistor in the driving circuit.

13. A method for driving the pixel circuit according to claim 1, the method comprising:

in a first time period, under the control of the control signal, providing the data signal to the first node, and providing the initialization signal to the second node to charge a capacitor;

in a second time period, under the control of the control signal, providing the threshold compensation signal to the second node, maintaining a voltage difference between the first node and the second node through the capacitor to control the voltage of the first node, and causing the light emitting device to emit light according to the voltage of the first node and a first voltage signal of a first voltage signal terminal.

14. The method according to claim 13, wherein in the first time period, the light emitting device is reset under the control of the control signal.

15. An array substrate comprising the pixel circuit according to claim 1.

16. A display device comprising the array substrate according to claim 9.

17. A pixel circuit, comprising a first transistor, a second transistor, a third transistor, a fourth transistor, a fifth transistor, a sixth transistor, a capacitor, and a light emitting device, wherein a control electrode of the first transistor is coupled to a control signal terminal, wherein a first electrode of the first transistor is coupled to a control electrode of the fourth transistor, and wherein a second electrode of the first transistor is coupled to a second node;

wherein a control electrode of the second transistor is coupled to the control signal terminal, wherein a first electrode of the second transistor is coupled to an initialization signal terminal, and wherein a second electrode of the second transistor is coupled to the second node;

wherein the capacitor is coupled between a first node and the second node;

wherein a control electrode of the third transistor is coupled to the first node, wherein a first electrode of the third transistor is coupled to a second electrode of the sixth transistor, and wherein a second electrode of the third transistor is coupled to a first end of the light emitting device;

wherein a control electrode and a first electrode of the fourth transistor are coupled to the first electrode of the first transistor, and wherein a second electrode of the fourth transistor is coupled to a first voltage signal terminal;

wherein a control electrode of the fifth transistor is coupled to the control signal terminal, wherein a first electrode of the fifth transistor is coupled to a data signal terminal, and wherein a second electrode of the fifth transistor is coupled to the first node;

wherein a control electrode of the sixth transistor is coupled to the control signal terminal, wherein a first electrode of the sixth transistor is coupled to the first voltage signal terminal, and wherein a second electrode of the sixth transistor is coupled to the first electrode of the third transistor;

wherein the first end of the light emitting device is coupled to the second electrode of the third transistor, and wherein a second end of the light emitting device is coupled to a second voltage signal terminal;

wherein the type of the first transistor is different from the type of the second transistor, and wherein the first transistor, the second transistor, the fifth transistor, and the sixth transistor are configured to operate according to a control signal from the control signal terminal.

18. The pixel circuit according to claim 17, wherein the types of the third transistor, the fourth transistor, and the sixth transistor are different from the type of the fifth transistor.

19. The pixel circuit according to claim 17, further comprising a seventh transistor, wherein a control electrode of the seventh transistor is coupled to the control signal terminal, wherein a first electrode of the seventh transistor is coupled to the first end of the light emitting device, and wherein a second electrode of the seventh transistor is coupled to the second voltage signal terminal, and wherein the seventh transistor is configured to operate according to the control signal from the control signal terminal.

20. The pixel circuit according to claim 19, wherein the type of the seventh transistor is different from the type of the third transistor.

* * * * *